US012661567B2

(12) United States Patent
Bollfrass

(10) Patent No.: US 12,661,567 B2
(45) Date of Patent: Jun. 23, 2026

(54) WATER SIMULATION SYSTEM AND METHOD

(71) Applicant: FATHOM TANKS LLC, Austin, TX (US)

(72) Inventor: Charles Bollfrass, Austin, TX (US)

(73) Assignee: FATHOM TANKS LLC, Austin, TX (US)

( * ) Notice: Subject to any disclaimer, the term of this patent is extended or adjusted under 35 U.S.C. 154(b) by 414 days.

(21) Appl. No.: 18/343,580

(22) Filed: Jun. 28, 2023

(65) Prior Publication Data

US 2023/0415017 A1 Dec. 28, 2023

Related U.S. Application Data

(60) Provisional application No. 63/356,401, filed on Jun. 28, 2022.

(51) Int. Cl.
*A63B 69/12* (2006.01)
*A63B 69/00* (2006.01)

(52) U.S. Cl.
CPC ..... *A63B 69/125* (2013.01); *A63B 69/0053* (2013.01); *A63B 2210/50* (2013.01)

(58) Field of Classification Search
CPC ..... A63B 69/125; A63B 69/0053; A63B 2210/50; G09B 23/12
See application file for complete search history.

(56) References Cited

U.S. PATENT DOCUMENTS

| | | | | |
|---|---|---|---|---|
| 5,044,021 | A * | 9/1991 | Murdock | A63B 69/125 4/488 |
| 5,881,401 | A * | 3/1999 | Saputo | E04H 4/1681 239/394 |
| 6,151,726 | A * | 11/2000 | Ajima | A63B 69/125 4/488 |
| 8,322,908 | B1 * | 12/2012 | Hartmann | E04H 4/169 366/136 |
| 10,202,781 | B1 * | 2/2019 | Orosco | B01F 25/50 |
| 2007/0214560 | A1 * | 9/2007 | Chivers | A63B 69/125 4/488 |
| 2008/0127405 | A1 * | 6/2008 | Hof | A63B 69/125 4/496 |
| 2009/0064404 | A1 * | 3/2009 | Frei | E04H 4/1218 4/506 |
| 2017/0204628 | A1 * | 7/2017 | Livingston, Jr. | F15B 11/08 |
| 2018/0100320 | A1 * | 4/2018 | Suri | E04H 4/12 |
| 2019/0194965 | A1 * | 6/2019 | Hall | E04H 4/0043 |
| 2020/0325698 | A1 * | 10/2020 | Allred | B66F 3/46 |
| 2021/0322849 | A1 * | 10/2021 | van der Weide | E04H 4/1245 |

FOREIGN PATENT DOCUMENTS

| | | | | |
|---|---|---|---|---|
| GB | 2524290 | A * | 9/2015 | G09B 19/00 |

* cited by examiner

*Primary Examiner* — James S. McClellan
(74) *Attorney, Agent, or Firm* — Workman Nydegger

(57) ABSTRACT

A water simulation system may include a tank, a plurality of fluidic inlets, a plurality of fluidic outlets, and one or more pumps. In operation, the one or more pumps may introduce liquid to the tank through the fluidic inlets and draw liquid from the tank through the fluidic outlets. A pressure at the fluidic outlets may be diffused through the tank by an intake diffusion system having an intake box and an intake plate separating the fluidic outlets from the interior of the tank. A liquid flow may be adjusted for creating swift water conditions in a first portion of the tank and a slower current in a second portion of the tank.

17 Claims, 14 Drawing Sheets

WATER SIMULATION SYSTEM AND METHOD

TECHNICAL FIELD

The disclosure relates to systems and methods for providing simulations of water-based conditions, such as may exist in natural rivers or other watercourses, during floods, storms, tides, tsunamis, or in other water related environments. Particular embodiments may relate to simulating swift water rescue conditions.

BACKGROUND

Some of the most underestimated dangers are those of natural bodies of water or water flows. As a force of nature, any significant accumulation of water can present several inherent hazards that potentially make any interaction deadly to the inexperienced and unprepared. Adding to the danger is the frequency and speed with which water conditions can change. Few places exist where flooding is not a possible issue, and changes in rainfall, snow melt, currents or in watercourses themselves can cause flash flooding, rip tides, and waves that can arrive with little to no warning.

At 1,000 kg/m$^3$, moving water can bring immense, continuous force to bear against any object in its path and create dangerous hydraulics, waves, and strainers. However, surface appearances often belie the dangers of these forces, as only six inches of flowing water that appears smooth on the surface can knock an adult from their feet, while only 12 inches can carry away most vehicles. Debris can be carried in and hidden by water, posing additional risks for injury and entrapment.

Water conducts heat about 25 times faster than air of the same temperature, potentially leaving a person in cold waters with only minutes of exposure before physical impairment begins and grows towards complete incapacitation. Even short-term exposure to low temperatures in water can leave individuals at risk of hypothermia and related effects. Exposure to pathogenic microorganisms transmitted through water presents the additional biological risk of waterborne diseases, while exposure to harmful chemicals in waters contaminated by pollution brings additional risk to any uncontrolled body of water. The risk of infection and harmful exposure can be dramatically increased due to the possibility of floodwaters carrying large amounts of agricultural pesticides, industrial chemicals, and sewage from containment areas.

As many of these risks are essentially invisible to the untrained, water-related emergencies are exceedingly common emergency situations. In Texas alone, 3,256 swift water rescues were reported between the years of 2005 and 2014.

Over half of all flood-related drownings occur when a vehicle is driven into hazardous flood water, with the second leading cause of flood-related deaths being walking into or near flood waters. Unfortunately, one third of all flood-related deaths are first responders who, as firemen, law enforcement officers, emergency medical technicians and paramedics, may put their lives at risk having little to no experience with water related hazards and rescue.

While technological advancements have provided specialized equipment and training for technical rescue, these same advancements have in some ways made it more difficult to broadly prepare first responders for water rescue events. Water rescue equipment, methods, and systems are often much more robust than those used in standard rescue operations, and the difficulty of safely replicating or simulating water related events makes the expense of time and resources required to provide adequate training prohibitive for the vast majority of first responders.

Although flooding and similar water events are possible in nearly any populated region, the primary challenge in training first responders for water rescue is the lack of a suitable training environment. Obviously, the fact that a neighborhood may flood at some future point does not make that neighborhood a suitable training ground for water rescue, nor does a body of water such as a standard pool or stationary pond present a user with any meaningful experience of the hazardous conditions that large quantities of moving water may exhibit in an emergency event.

Even where natural watercourses are available for training purposes, training can be expensive, dangerous, and overall insufficient. As is generally apparent, using a natural watercourse as a training environment means exposing trainees to many of the actual hazards of moving water without any significant means of control. An operator generally cannot reduce a current in a river for abandoning an exercise that has become dangerous, and even scouting a site in advance gives only limited information on what hidden or future conditions may await trainees. Hypothermia, infection, and drowning remain real risks for all those that are exposed to these natural environments while, on the other hand, bright daylight conditions at a familiar location in fair weather may offer limited benefits to trainees over a standard swimming pool.

Natural watercourses generally cannot be adapted to the desires or needs of a particular training, at least without significant monetary and environmental costs. In much the same way, it can be difficult to practice the use of expensive equipment in natural environments without actually using it, incurring expensive wear and tear. For example, practicing a rescue involving a helicopter in a natural river will generally require the use of a helicopter which, especially for the needed duration or frequency of a training procedure, can be too expensive to justify.

Significant expense has been exerted in preparing specialized water rescue training campuses in some areas. These often include massive, purpose-built facilities extending over several acres, including large retaining ponds, towers, block systems, and concrete channels through which water flows from a high point over artificial obstacles to a low point using the force of gravity. Some include entire mock neighborhoods, with streets and buildings that can be inundated on demand. The enormous cost of these man-made rivers and floods is justified by the essential, lifesaving training they provide, but their influence is limited due to the low number that can afford to build them and the requirement for most to travel great distances for access.

These facilities rely on sheer scale to simulate emergency water conditions, which in turn limits the control of operators over the details of the environment presented to a user. In particular, the cost of enclosing even a portion of these facilities would be inordinately expensive, meaning that they are generally all outdoor environments subject to related weather and ambiance. Similarly, the use of gravity to simulate water conditions limits control of water flows to the use of configurable blocks that can require significant time and energy to adjust, and then often in only limited preset configurations. Adapting known facilities to new training methods can require expensive rebuilding efforts, even involving the demolition of previous facilities, such that these facilities are generally not adaptable beyond their original designs.

The large quantities of water and high suction power required for operating these facilities also introduce challenges relating to waste and safety. Known systems can require excessive amounts of water to operate, which water can also be difficult to keep clean. Large suction pumps can similarly require specialized construction and can be difficult to power, while introducing the significant risk of suction entrapment to users.

Accordingly, there remains a need for systems and methods for simulating a water environment that offer increased accessibility, flexibility, control and portability. In like manner, there is a need for systems and methods for simulating a water environment that provide both a more accurate experience for the trainee and an increased level of safety, all while being relatively inexpensive and simple to use, making an economical and effective replacement for known systems and methods.

SUMMARY

Embodiments of the present disclosure advantageously provide water simulation systems in the form of a tank defining an opening for containing a simulation of water conditions and/or a water related event, such as a flood or swift water rescue. The disclosed water simulation embodiments can be produced, assembled and employed at substantially lower material and labor costs than known in the prior art, while dramatically increasing the level of safety and control in accurate simulations of water conditions.

According to an embodiment, a water simulation system is provided in the form of a tank defining an opening at a top end. The tank may be in the form of any vessel, container or pool that may be assembled and disassembled for portability and configured for holding a significant quantity of liquid, the tank formed of materials such as steel and the like. A plurality of fluidic inlets may be provided in a first end of the tank and a plurality of fluidic outlets may be provided in first side and second side of the tank. The tank may be filled with a liquid, such as water, the water simulation system including one or more pumps configured to introduce liquid into the tank through the plurality of fluidic inlets at a first velocity and in a first direction extending from the first end to the second end, and to draw the liquid from the tank through the plurality of fluidic outlets.

In varying embodiments, the plurality of fluidic inlets may include a plurality of swift water inlets and a plurality of current water inlets. The one or more pumps may be configured to introduce the liquid into the tank through the plurality of current water inlets at the first velocity and in the first direction, and to introduce the liquid into the tank through the plurality of swift water inlets at a second velocity and in the first direction, the second velocity being higher than the first velocity.

The swift water inlets may be arranged to introduce liquid into the tank at a height greater than a height of the plurality of current water inlets, such as to create a swift water flow at a surface region of the tank and a slower water flow below, such that swift water with white caps, rapids, and other dangerous conditions needed for an accurate simulation are only provided in a limited portion of the tank, such as a top portion. A slower water flow below the swift water improves the safety of the simulation, without substantively reducing its fidelity.

The simulation may be adjusted further by configuring a flow rate, height/depth, position and direction of a liquid introduced to the tank. The water simulation system may include snorkels at the fluidic inlets for this purpose, the snorkels comprising at least a reducer and a corresponding arm. In varying embodiments, a number and arrangement of the fluidic inlets may be adjusted to achieve desired water conditions.

In embodiments, the plurality of fluidic outlets may comprise an intake diffusion system that prevents suction entrapment in the tank. The intake diffusion system may include an intake box defining a recess in the first and/or second sides of the tank. An intake plate having a plurality of intake holes may close an end of the recess, such that the liquid of the tank is able to pass through the intake plate while diffusing a suction pressure of the fluidic outlets. The intake diffusion system may extend along a length of the sides of the tank, such that the suction power of the fluidic outlets is diffused across an entire length of the tank, or across a majority of the length of the tank, or across a portion of the length of the tank.

According to embodiments of a method for performing water simulations, a liquid may be simultaneously introduced through the fluidic inlets and withdrawn through the fluidic outlets. A swift water flow may be formed at a surface of a liquid in the tank while a slower flow is formed below the swift water flow. The water drawn through the fluidic outlets may be drawn by a diffused pressure that is distributed along the length of the tank.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not, therefore, to be considered to be limiting in scope, embodiments will be described and explained with additional specificity and details through the use of the accompanying drawings in which.

Figure 1A:
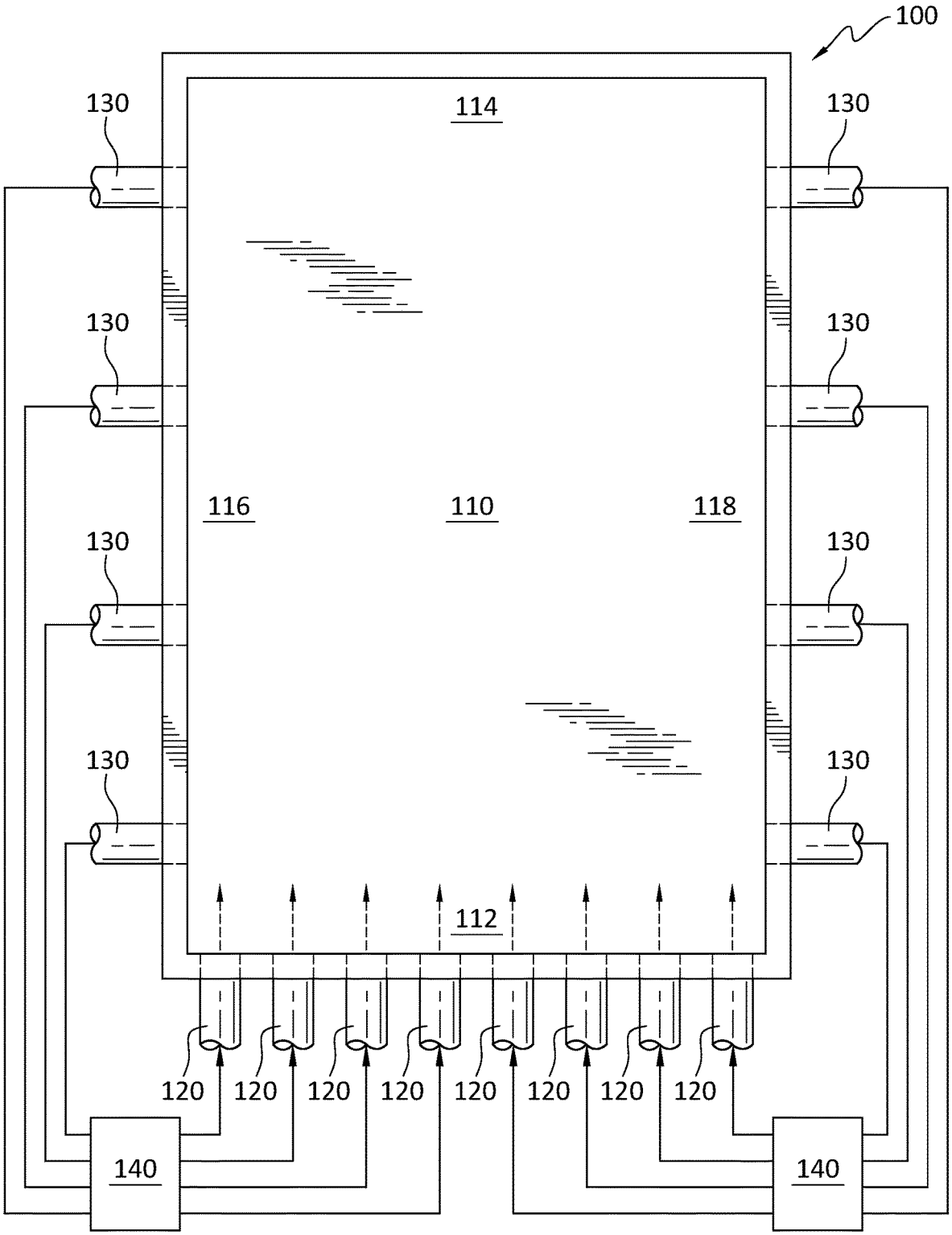
FIG. 1A is a top-down diagram of a water simulation system according to an embodiment of the disclosure.

The drawing figures are not necessarily drawn to scale, but instead are drawn to provide a better understanding of the components, and are not intended to be limiting in scope, but to provide exemplary illustrations. The figures illustrate exemplary configurations of water simulation systems and related methods, and in no way limit the structures or configurations of water simulation systems and methods according to the present disclosure.

DESCRIPTION

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and are described below. It should be understood, however, that there is no intention to limit the disclosure to the specific embodiments disclosed, but on the contrary, the intention covers all modifications, alternative constructions, combinations, and equivalents falling within the spirit and scope of the disclosure. The dimensions, angles, and curvatures represented in the figures introduced above are to be understood as exemplary and are not necessarily shown in proportion. The embodiments of the disclosure may be adapted or dimensioned to accommodate use for simulating different water conditions or environments as would be understood from the present disclosure by one skilled in the art.

It will be understood that unless a term is expressly defined in this application to possess a described meaning, there is no intent to limit the meaning of such term, either expressly or indirectly, beyond its plain or ordinary meaning. Unless defined otherwise, all technical and scientific terms used herein have the same meaning as commonly understood by one of ordinary skill in the art to which the present disclosure pertains. Although a number of methods and materials similar or equivalent to those described herein can be used in the practice of the present disclosure, the preferred materials and methods are described herein.

It is to be noticed that the term "comprising," which is synonymous with "including," "containing," "having" or "characterized by," should not be interpreted as being restricted to the means listed thereafter; it does not exclude other or additional, unrecited elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present disclosure, the relevant components of the device are A and B.

It will be noted that, as used in this specification and the appended claims, the singular forms "a," "an" and "the" include plural referents unless the content clearly dictates otherwise. Thus, for example, reference to a "pump" includes one, two, or more pumps.

Numbers, percentages, ratios, or other values stated herein may include that value, and also other values that are about or approximately the stated value, as would be appreciated by one of ordinary skill in the art. As such, all values herein are understood to be modified by the term "about". A stated value should therefore be interpreted broadly enough to encompass values that are at least close enough to the stated value to perform a desired function or achieve a desired result, and/or values that round to the stated value. The stated values include at least the variation to be expected in a typical manufacturing process, and may include values that are within 10%, within 5%, within 1%, etc. of a stated value.

Some ranges may be disclosed herein. Additional ranges may be defined between any values disclosed herein as being exemplary of a particular parameter. All such ranges are contemplated and within the scope of the present disclosure.

Reference throughout this specification to "one embodiment," "one aspect," or "an embodiment" means that a particular feature, structure or characteristic described in connection with the embodiment is included in at least one embodiment of the present disclosure. As used herein, the term "embodiment" or "aspect" means "serving as an example, instance, or illustration," and should not necessarily be construed as preferred or advantageous over other embodiments disclosed herein. Thus, appearances of the phrases "in one embodiment," "in one aspect," or "in an embodiment" in various places throughout this specification are not necessarily all referring to the same embodiment but may. Furthermore, the particular features, structures or characteristics may be combined in any suitable manner, as would be apparent to one of ordinary skill in the art from this disclosure, in one or more embodiments.

Similarly, it should be appreciated that in the description of exemplary embodiments of the disclosure, various features of the disclosure are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the embodiments require more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this disclosure.

Furthermore, while some embodiments described herein include some, but not other features included in other embodiments, combinations of features of different embodiments are meant to be within the scope of the disclosure, and form different embodiments, as would be understood by those in the art. For example, in the following claims, any of the claimed embodiments can be used in any combination.

In the description provided herein, numerous specific details are set forth. However, it is understood that embodiments of the disclosure may be practiced without these specific details. In other instances, well-known methods, structures and techniques have not been shown in detail in order not to obscure an understanding of this description.

The various embodiments of the disclosure relate to water simulation systems and methods as may be employed in trainings or other simulations creating the appearance and feel of certain water conditions, such as swift water and/or flood conditions. The water simulation systems and methods advantageously can provide the appearance and feel of dangerous water conditions, with a significantly reduced risk to users relative to known systems and methods. Moreover, the disclosed embodiments may be produced and used while significantly reducing material, operation and/or labor costs, by enabling the water simulation system to be easily and quickly controlled during use, adapted to changing requirements, readily assembled on-site, and/or disassembled for movement to another location or storage, thereby minimizing inefficiencies, risks and waste inherent to the construction and use of prior art systems.

A water simulation system 100 according to an embodiment is shown in FIG. 1A. The water simulation system 100 may include a tank 110, a plurality of fluidic inlets 120, a plurality of fluidic outlets 130, and one or more pumps 140. The tank 110 may comprise any tank, vessel, and/or container for containing a liquid, e.g., water, that may be assembled and disassembled for portability. Accordingly, tank 110 may be constructed from any suitable material, preferably steel or related materials. The embodiments are preferably formed of steel plates which advantageously allows for the system to withstand the weight of the liquid, particularly in a rectangular configuration, and permits ready assembly and disassembly. Further, the tank 110 may be dimensioned or shaped according to the requirements of known pools, water channels or related natural environments, a size and shape of the tank 110 varying according to attributes of an intended simulation, for example based on a desired flow path, as would be understood by one skilled in the art from the present disclosure. The water simulation system 100 is thus advantageously adaptable and/or reconfigurable for different applications.

Depicted in FIG. 1A is a top-down plan view of selected components of a water simulation system 100 incorporating features of the present disclosure. As discussed below in more detail, water simulation system 100 is configured to provide a simulation of hazardous water conditions in a select portion of the tank 110, while maintaining more stable, predictable and generally safer conditions in other portions. The tank 110 may include a first end 112 opposite a second end 114 and a first side 116 opposite a second side 118. The tank 110 may have an open top and a closed bottom. In an exemplary but non-limiting embodiment the water simulation system 100 may be configured as a swift water simulation system, the liquid may comprise water, and the tank 110 may comprise a plurality of bolted-metal panels. In certain embodiments, a plurality of connectors may be provided for securing the panels, such as bolts, gaskets, washers, nuts, bars, frames, etc. While welds may be used for coupling panels in some embodiments, the welds must be cut or ground for disassembly, such that it may be preferred to use only readily removable connectors, such as with a bolted assembly.

While described for convenience in the current disclosure as one or more pumps 140, it should be appreciated that a pump 140 may be provided in any form suitable for driving and/or drawing a liquid. The pump 140 may comprise any mechanical or electro-mechanical system, apparatus, or device operable to produce a flow of fluid in the tank 110 and/or through fluidic inlets 120 and fluidic outlets 130. For example, the pump 140 may produce fluid flow by applying a pressure to water in a respective fluidic inlet 120 or outlet 130. In operation, the one or more pumps 140 may be configured to introduce liquid into the tank 110 through the plurality of fluidic inlets 120 at a first velocity and in a first direction extending from the first end 112 to the second end 114, and to draw the liquid from the tank 110 in a second direction through the plurality of fluidic outlets 130, as illustrated in FIG. 1A. The second direction may be substantially orthogonal to the first direction.

The one or more pumps 140 may be controlled by a control system or processor (not shown) which may control electro-mechanical components (e.g., motors, valves, etc.) of the one or more pumps 140 in order to produce a desired flow rate of liquid through a respective fluidic inlet 120 or outlet 130. A fluidic inlet 120 and fluidic outlet 130 according to the disclosure may include any suitable mechanical structure through which a fluid (e.g., water) may flow, including without limitation a pipe or tube and related components. In certain aspects, the fluidic inlet 120 and fluidic outlet 130 may include electro-mechanical components (e.g., motors, valves, etc.) which may be controlled by the control system and/or a further control system. In a preferred embodiment, one pump is provided for each pair of a fluidic outlet and a fluidic inlet.

Figure 1B:
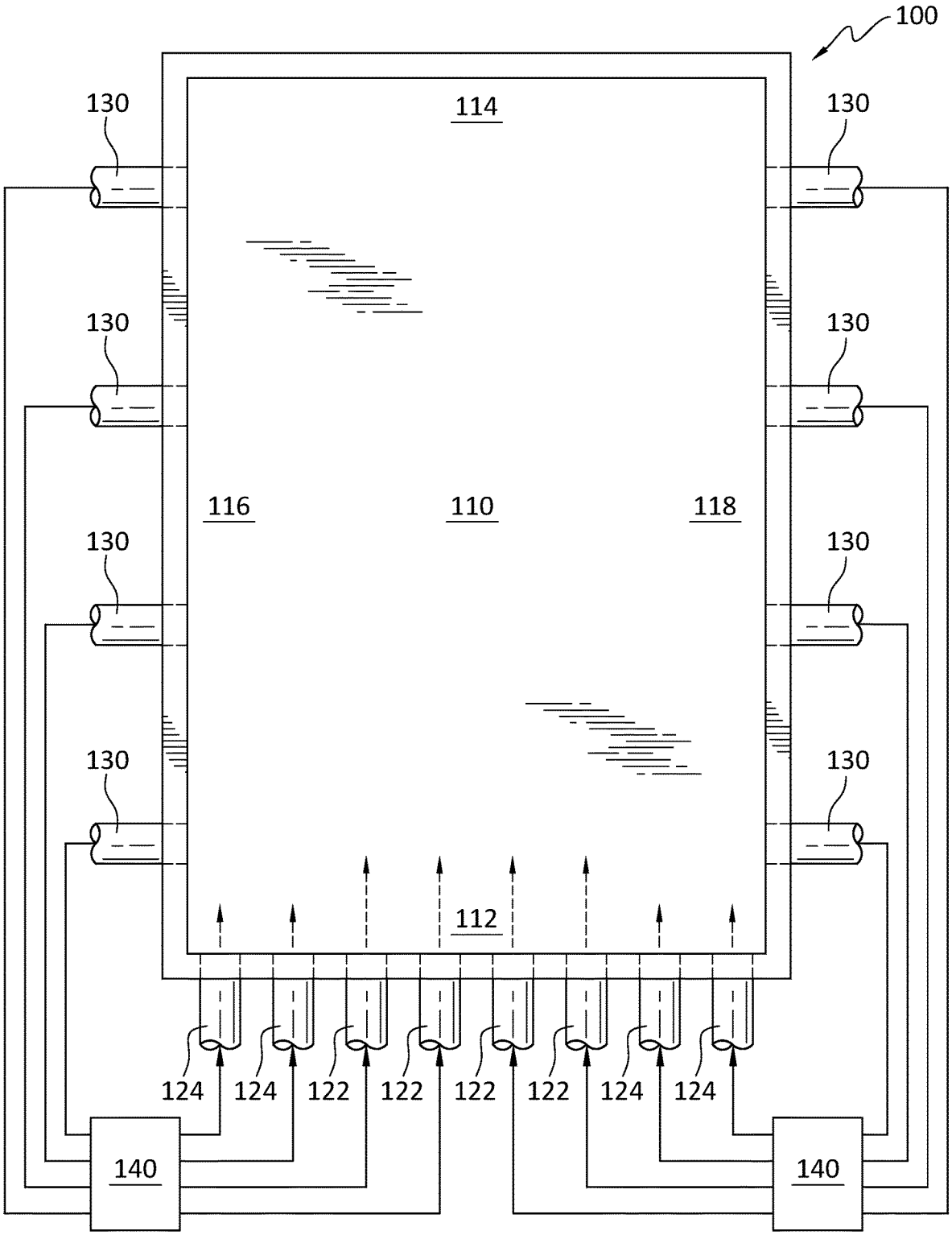
FIG. 1B is a top-down diagram of a water simulation system according to another embodiment of the disclosure.

In operation, the flow rates through the plurality of fluidic inlets 120 and/or the plurality of fluidic outlets 130 may be controlled to achieve a desired flow of liquid through tank 110. In one aspect, according to the embodiment of FIG. 1B, flow rates may be set higher near the center of tank 110 than near the sides 116, 118 of tank 110, which may simulate a watercourse with greater water flow in the center of the watercourse and slower water flow near banks of the watercourse. In another aspect, different flow rates may be set at the various individual fluidic inlets 120 and/or outlets 130 in order to generate particular water currents, undertows, or other dynamic fluid effects.

In certain embodiments, the plurality of fluidic inlets 120 may include a plurality of swift water inlets 122 and a plurality of current water inlets 124. The one or more pumps 140 and/or the plurality of swift water inlets 122 and the plurality of current water inlets 124 may be configured to introduce the liquid into the tank 110 through the plurality of current water inlets 124 at the first velocity and in the first direction, and to introduce the liquid into the tank 110 through the plurality of swift water inlets 122 at a second velocity and in the first direction, the second velocity being higher than the first velocity. According to varying examples, the second velocity may be in the range of 1.5 to 3.5 knots higher than the first velocity.

Figure 1C:
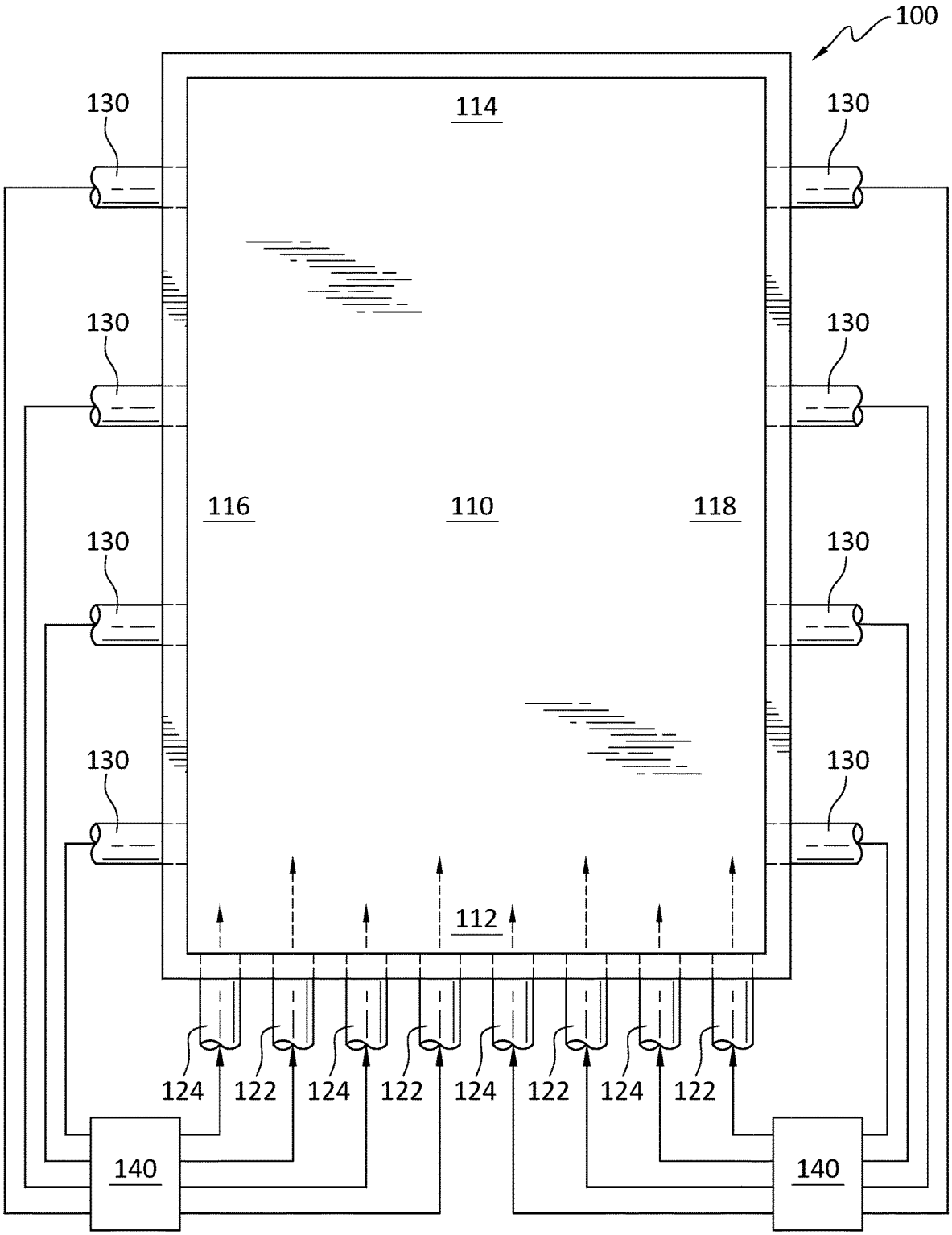
FIG. 1C is a top-down diagram of a water simulation system according to another embodiment of the disclosure.
Figure 2:
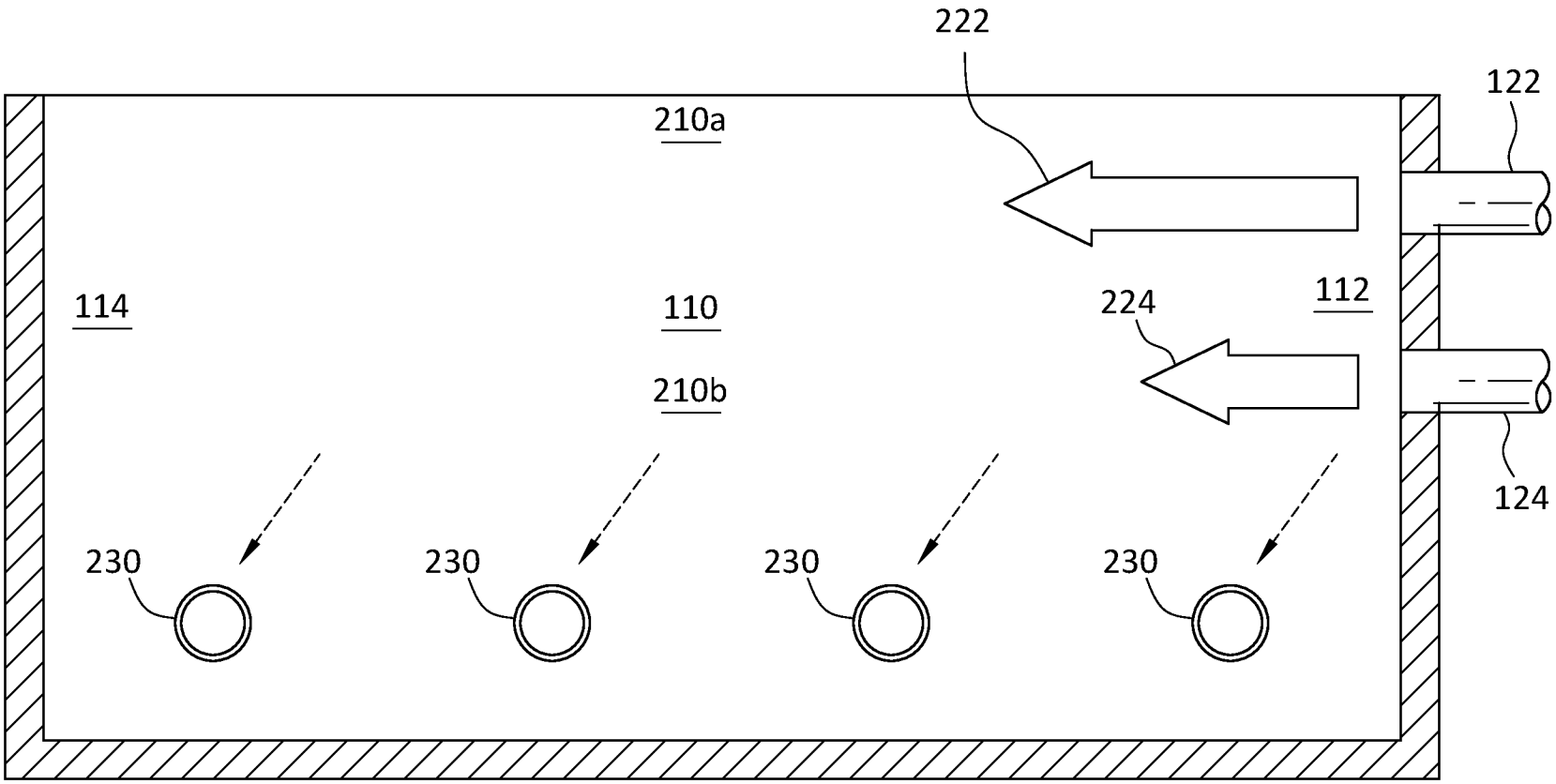
FIG. 2 is a cutaway-side diagram of a water simulation system according to the embodiment of FIG. 1C.

In some embodiments, the swift water inlets 122 may be configured to introduce the liquid into the tank 110 at a height greater than a height of the plurality of current water inlets 124, such as to create a swift water flow 222 and a current water flow 224, as illustrated in FIGS. 1C and 2. In this manner, water nearer a surface of tank 210 may move faster in the first direction and/or be more turbulent than water below, advantageously presenting white caps, rapids, and more dangerous conditions in only a limited upper portion 210*a* of the tank 110, while a slower, more stable flow may be simultaneously provided in another lower 210*b* portion of the tank 110 for preserving safety. This separation of the swift water flow 222 and the current water flow 224 improves the life-like simulation experience provided to a user while significantly reducing the risk to the same user. For example, should the user succumb to the difficult conditions presented by the swift water flow 222 and be submerged in the lower current water flow 224, the user would be more capable of recovering and safely exiting or continuing a training exercise due to the slower speed of the current water flow 224. Likewise, a user may be better able to maintain footing in the current water flow 224 while performing a training action with an upper body subject to the swift water flow 222.

In preferred embodiments, the swift water inlets 122 may be configured to introduce the liquid into the tank 110 at a height greater than a height of the plurality of current water inlets 124 but at the same output velocity, in such a manner that the first velocity and the second velocity higher than the first velocity result in the tank. For example, the swift water inlets 122 may be located about 12 inches above the current water inlets 124 and/or about 6 inches above a waterline in the tank, or may be configured to include an extension or snorkel for adjusting an end position of the swift water inlets 122 for this effect. The swift water inlets 122 and current water inlets 124 may both introduce a liquid into the tank at about 3 knots but, due to the position of the swift water inlets 122 above the waterline, the flow introduced by the swift water inlets 122 skips on the surface and forms a swift water flow of about 6 to 7 knots while a current water flow formed by the current water inlets 124 has a speed of about 2 to 3 knots.

Figure 3:
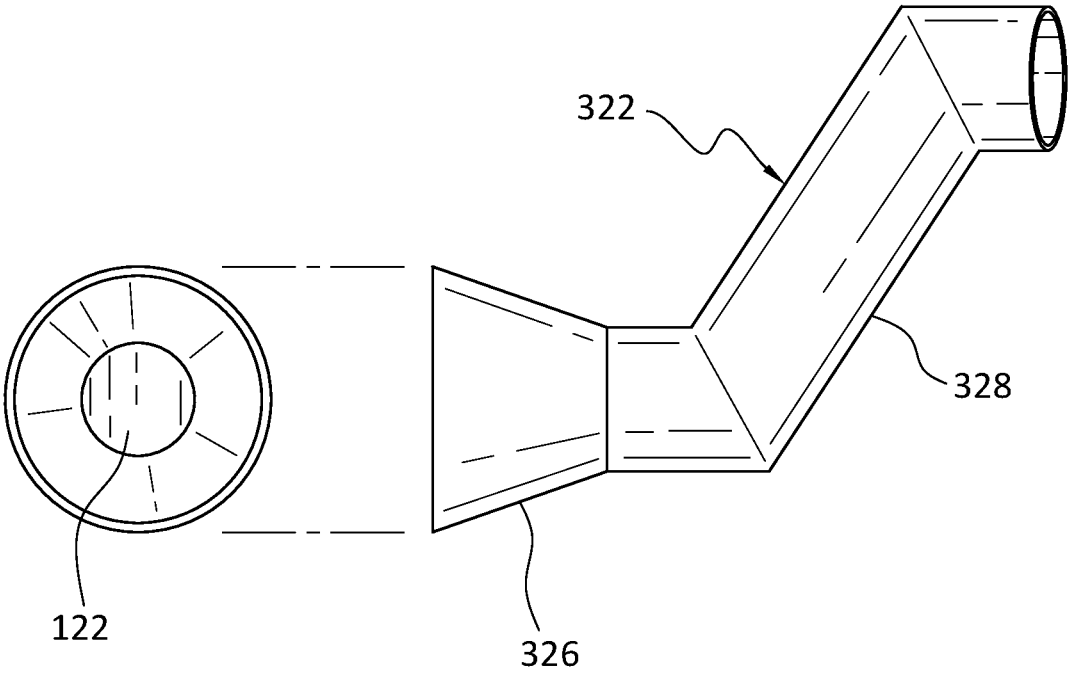
FIG. 3 is a diagram of a snorkel for a water simulation system according to embodiments of the disclosure.

Embodiments of the swift water inlets 122 may be configured to adjust a flow rate, height, position and direction of a liquid introduced to the tank 110. According to the embodiment of FIG. 3, the swift water inlets 122 may each include a snorkel 322. The snorkel 322 may comprise a reducer 326 for increasing the velocity of the liquid through the plurality of swift water inlets 122 and/or an extended arm 328 for adjusting the height, direction, and/or position at which the plurality of swift water inlets 122 introduce the liquid into the tank 110. The snorkel may have a height of about 12 inches, and may have a diameter of about 10 inches to 6 inches. A reducer 326 may provide a change in diameter from about 10 inches to 6 inches, or a similar change for increasing the velocity of the liquid.

In varying aspects, the snorkel 322 may be configured to be rotatable at one or more points thereon for adjusting a height, direction, and/or position at which the liquid is introduced into the tank 110 from the plurality of swift water inlets 122. The adjustable snorkel 322 provides an advantageous configurability to the water simulation system, such that different eddies, rip currents, or other water features may be created as desired. In particular, the snorkel 322 may be rotated at angled portions thereof, such as at two 90-degree angles forming the snorkel arm, or at two 45-degree angles or the like, according to FIG. 3. In some examples, the snorkel 322 may have a height of about 12 inches. In an embodiment, the snorkel 322 may increase the height at which the liquid is introduced into the tank to be higher than a level of liquid in the tank and/or higher than the tank itself.

In some embodiments, the swift water inlets 122 and/or the current water inlets 124 may be configured to adjust a flow rate of a liquid introduced to the tank 110 by incorporating a reducer in the swift water inlets 122 and/or the current water inlets 124 before the first end 112, by incorporating pumps of differing strength or power, and/or by another means for controlling a flow rate of a liquid.

In varying embodiments, the plurality of fluidic inlets 120 may be arranged according to a particular water condition or simulation. In some examples, the fluidic inlets 120 may all be at the same position and/or use the same velocity, for example at a height of about 3.5 feet, the swift water inlets 122 and the current water inlets 124 being distinguished by the swift water inlets 122 each including a snorkel 322. The snorkels 322 may be removable from one fluidic inlet to another, such that the system may be reconfigured for simulating different water conditions.

In some embodiments, a snorkel may be provided on only one fluidic inlet, on more than one fluidic inlet, on all but one fluidic inlet, or on all fluidic inlets. The use of more snorkels creates more white water or rapids in the upper layer of the tank with an even slower current below, while operation without snorkels where the fluidic inlets are at the same height forms a current that is consistent and strong enough that it cannot be walked against. Preferably, a number of snorkels provided is equal to half a number of fluidic inlets, such that the number of swift water inlets and current water inlets are equal.

A number of the plurality of swift water inlets 122 may be equal to a number of current water inlets 124, greater than the number of current water inlets 124, or less than the number of current water inlets 124. In another aspect, the plurality of fluidic inlets 120 may be arranged across a horizontal dimension of the first end 112 of the tank 110, such that the plurality of swift water inlets 122 and the plurality of current water inlets 124 are arranged alternatingly across said horizontal dimension. In varying examples, three fluidic inlets may be provided for each 10 foot width of the tank, although the number of fluidic inlets may vary according to the specifications of a desired simulation, and the number of fluidic inlets in operation at any given time may of course be adjusted according to the desired simulation. In some embodiments, only the first end 112 may be provided with fluidic inlets 120.

Figure 4A:
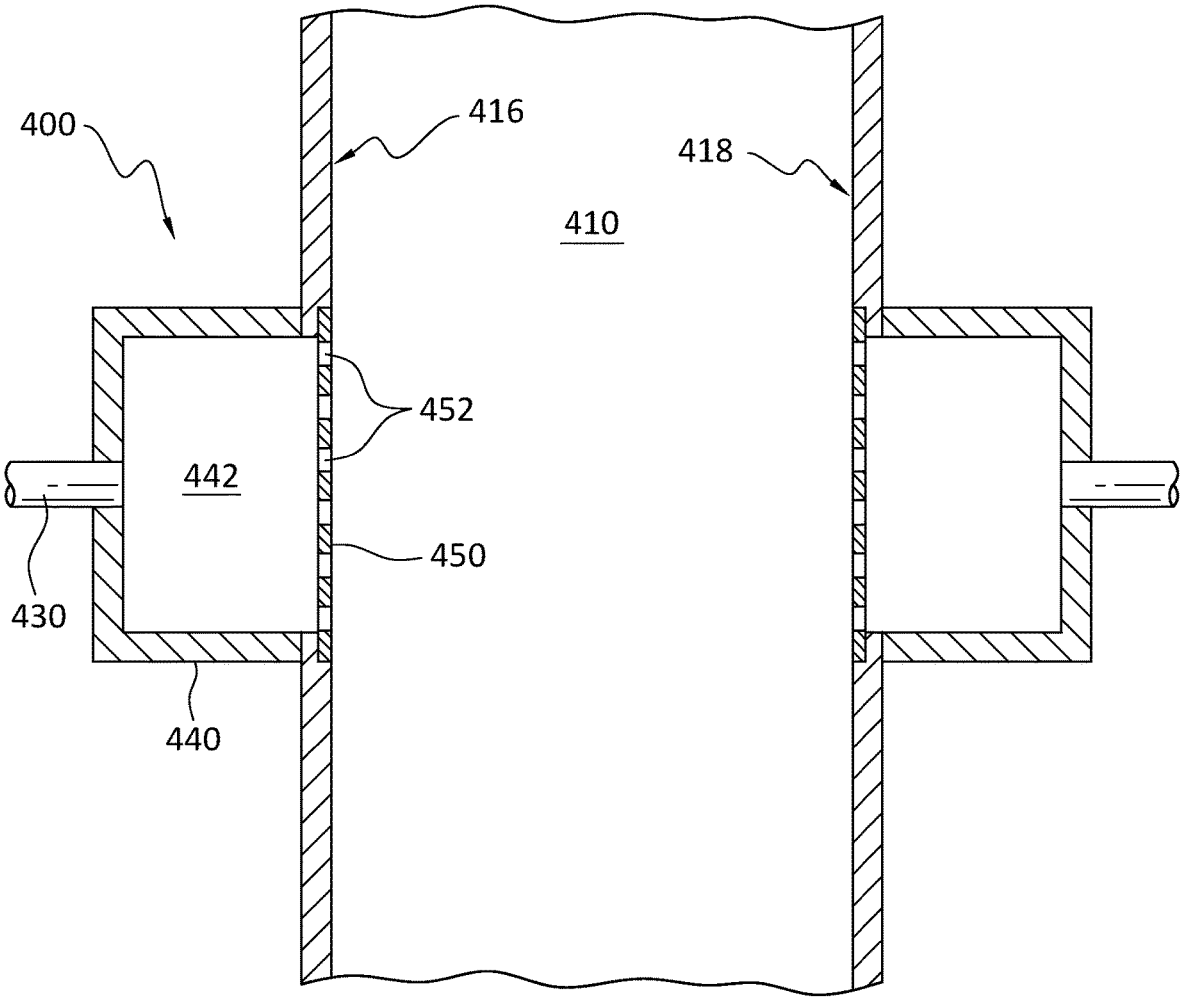
FIG. 4A is a cutaway-end diagram of a intake diffusion system according to an embodiment of the disclosure.
Figure 4B:
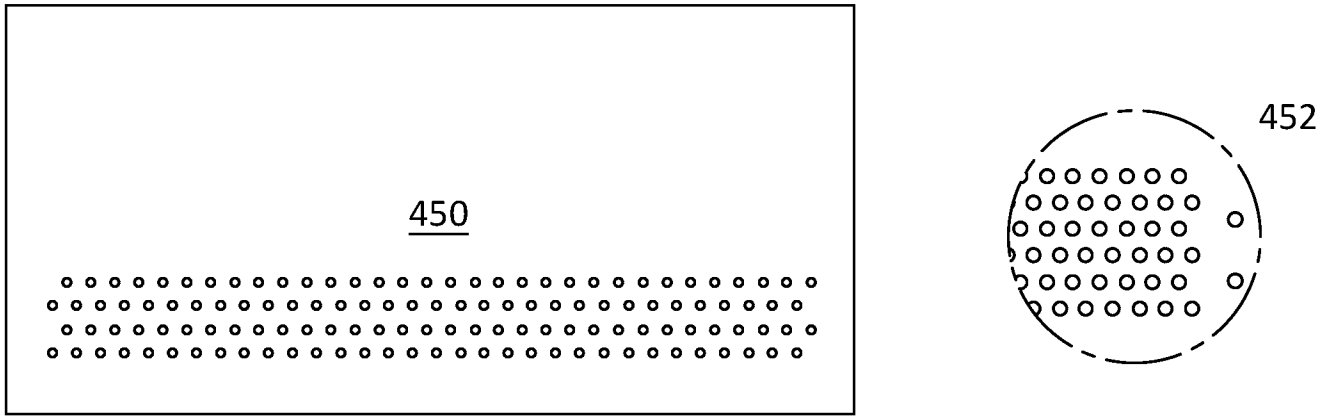
FIG. 4B is a diagram of a side panel of a tank of a water simulation system configured for an intake diffusion system according to FIG. 4A.

The plurality of fluidic outlets 130 may comprise an intake diffusion system 400, as illustrated in FIG. 4A. The intake diffusion system 400 may comprise at least one intake box 440 defining a recess 442 in the first and/or second sides 416, 418 of the tank 410. An intake plate 450 may close an end of the recess 442, the intake plate 450 arranged to correspond, e.g., in shape and/or dimension, with the corresponding first and/or second side 416, 418 of the tank 410. The intake plate 450 may define a plurality of intake holes 452 through which the liquid of the tank 410 is able to pass, as shown in FIG. 4A and FIG. 4B. One or more fluidic outlets 430 may be defined in the intake box 440 opposite the intake plate 450.

In operation, the liquid of the tank 410 may be drawn through the intake plate 450 into the intake box 440 and subsequently through the fluidic outlets 430 under a suction pressure. Due to the configuration of the intake diffusion system 400, a suction pressure is greater within the intake box 440 than at an opposing side of the intake plate 450, owing to the diffusion of the suction pressure across a greater surface area. Advantageously, although high velocity water conditions may be presented in the tank 410, the intake diffusion system allows that only a minimal, and safe, level of suction pressure is potentially exposed to the user within the tank.

Each of the fluidic outlets 130 may comprise a corresponding intake diffusion system 400, or a plurality of fluidic outlets may share a single intake diffusion system. In certain examples, a first intake diffusion system 400 may be provided on the first side of the tank and a second intake diffusion system 400 may be provided on the second side of the tank. In other examples, one or more first intake diffusion systems 400 may be provided on the first side of the tank and one or more second intake diffusion systems 400 may be provided on the second side of the tank. The arrangement of the intake diffusion system may be such that a length of the intake diffusion system or a combined length of the intake diffusion systems of one side may extend over at least 50%, or more preferably 75% of a length of the corresponding side of the tank on which it is located. In some cases, the intake diffusion system may extend over a length covering 100% of the length of the respective side of the tank. In varying aspects, fluidic outlets 130 and corresponding diffusion systems may be provided in only one side of the tank, in both sides of the tank, or in any combination of the first side 116, the second side 118, and the second end 114.

Figure 5:
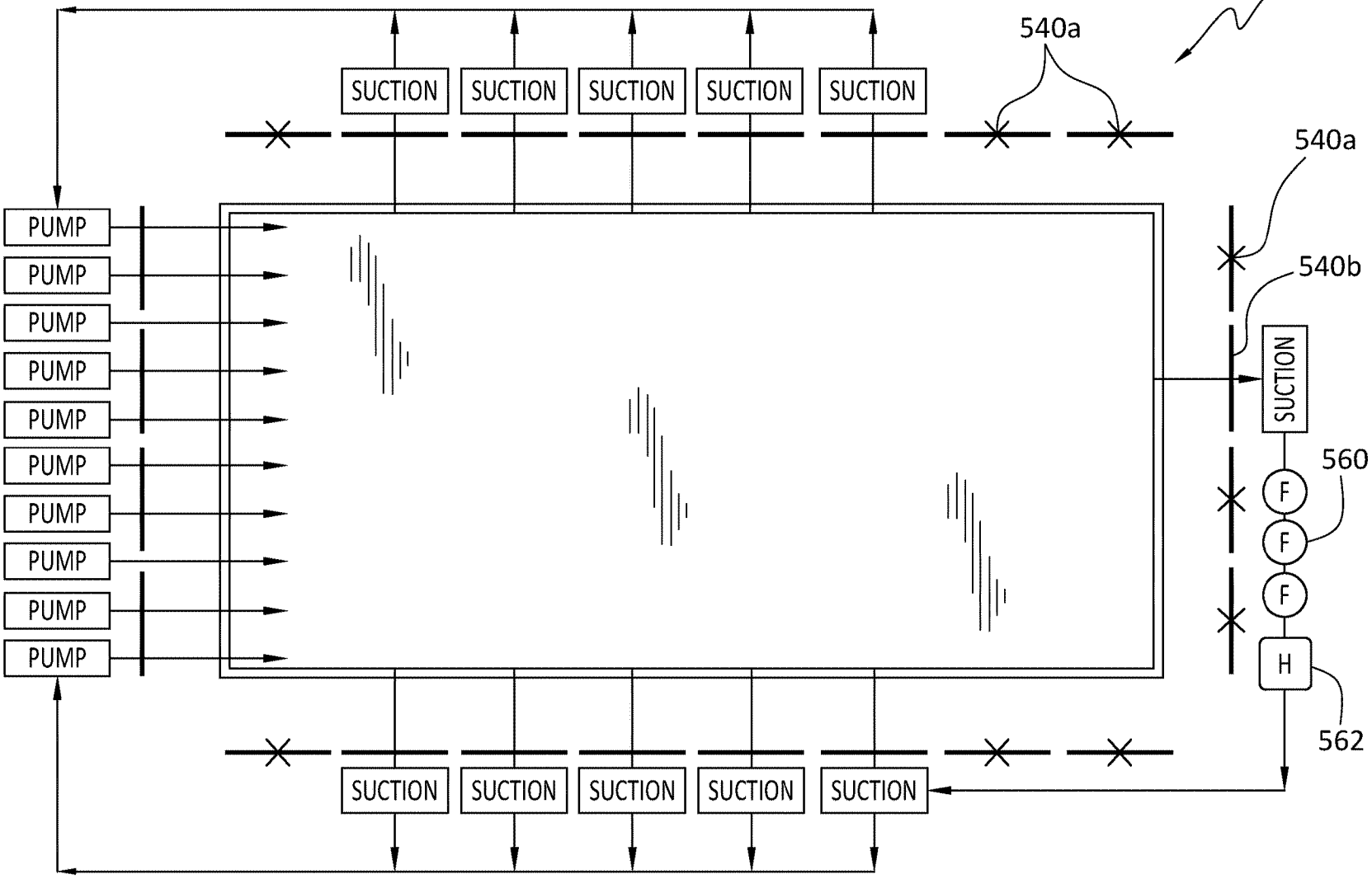
FIG. 5 is a top-down diagram of a water simulation system according to another embodiment of the disclosure.

In another aspect of varying embodiments, portions of the first side 116, the second side 118, and the second end 114 may include supplemental intake diffusion systems that do not include a fluidic outlet and are closed, as shown in the supplemental intake diffusion systems 540*a* of FIG. 5, or that include a supplemental fluidic outlet that connects to a supplemental system of the tank, as shown in the supplemental intake diffusion system 540*b* of FIG. 5. A supplemental system of the tank may include a filtration system including one or more water filters, a temperature control system including one or more water heaters or coolers, a weather simulation system including shower heads or the like for simulating rain or water spray above the tank, or similar systems. In varying aspects, the intake diffusion systems may be configurable, such that an operator may adjust which intake diffusion systems include a fluidic outlet and which are closed, for example adjusting according to the diagram of FIG. 5.

Each of the intake holes defined in the intake plate 450 may have a maximum dimension of 0.25 inches, 0.5 inches, or 1 inch. Alternatively, a maximum dimension of the intake holes may be in the range of 0.15 inches to 1.25 inches. The maximum dimension of the intake holes is configured to diffuse the suction pressure across the intake holes. As such, the intake holes may be spaced apart by less than five inches, less than 2.5 inches or by 1 inch, across the length dimension of the intake plate. The intake holes may be located above about 1 inch or above about 2 inches height from the floor of the tank and below about 14 inches or about 12 inches height from the floor of the tank. In an example embodiment, each 6 foot tall by 10 foot long panel including intake holes may include about 1,000 intake holes, each of the intake holes having an intake value of about 2.45 gallons per minute (gpm), such that the wall panel may have an intake volume of about 2,450 gpm.

In embodiments, the intake holes may comprise at least 10% of a surface area defined by the intake plate of the fluidic outlets, more particularly between 8% and 45%, between 10% and 30%, or up to 25%. In another aspect, the number and dimension of the intake holes may be configured such that a combined surface area of the intake holes is at least 200% of a surface area of the corresponding fluidic outlet or outlets 430, or between 200% and 500%. According to another variation, the intake holes may comprise between 1% and 3% of a total surface area of a corresponding side of the tank 410, more particularly between 1.5% and 2.5%, or 1.75% and 2.25%.

In varying examples of the disclosure, an intake diffusion system 400 may have a recess 410 wherein a distance between a back wall containing the fluidic outlet or outlets 410 and the intake plate 450 is between 8 and 16 inches, more particularly 10 and 14 inches, or about 12 inches.

In varying embodiments, the plurality of fluidic inlets 120, and the plurality of fluidic outlets 130 may be fluidically coupled by fluidic paths. For example, the fluidic paths may comprise a water pipe, conduit or the like, such as having a diameter in a range of about 6 to 14 inches, more particularly about 8 to 12 inches, or about 10 inches. An example of fluidic paths 670 may be seen in FIG. 6. In some examples, a number of fluidic inlets 120 may be equal to a number of fluidic outlets 130, may be greater than the number of fluidic outlets 130, or may be less than the number of fluidic outlets 130. In a preferred embodiment, three fluidic inlets are provided for each 10 foot width of the tank, although the fluidic inlets may be opened or closed depending on the desired flow conditions. In one aspect, the tank 110, the plurality of fluidic inlets 120, and the plurality of fluidic outlets 130 may form a contained, closed loop system.

In certain embodiments, the water simulation system 100 may be configured to provide swift water or white-water conditions in about 50% of the tank 110, such as in an upper 50% of the tank, and calmer conditions in the remainder of the tank 110. In a preferred embodiment, swift water conditions may be presented at a surface of the liquid in the tank and extending to a depth of about 6 inches.

As swift water conditions cannot naturally abate in a relatively small area, the velocity of the swift water must be compensated with a corresponding suction force to prevent the swift water from rebounding against the second side 114 of the tank 110. Given the strength of the water flow at the fluidic inlets 120 of the system 100, a corresponding suction force would generally create a suction entrapment hazard, such that users could be forcibly drawn against an outlet of the system, leading to injury or death. Advantageously, rather than simply drawing water, the intake diffusion system 400 of current embodiments diffuses suction power across a much broader area of the tank 110 using intake plates 450, even across the entire length of the tank, such that users cannot be exposed to areas of the fluidic outlets where a suction power may risk injury. Further, the intake diffusion system accomplishes the additional advantage of not disturbing the swift water simulation in the tank, while preventing any waves from bouncing back to the swift water from contact with the tank. These advantages are created while still maintaining low costs and low complexity in operation and assembly/disassembly.

Figure 6:
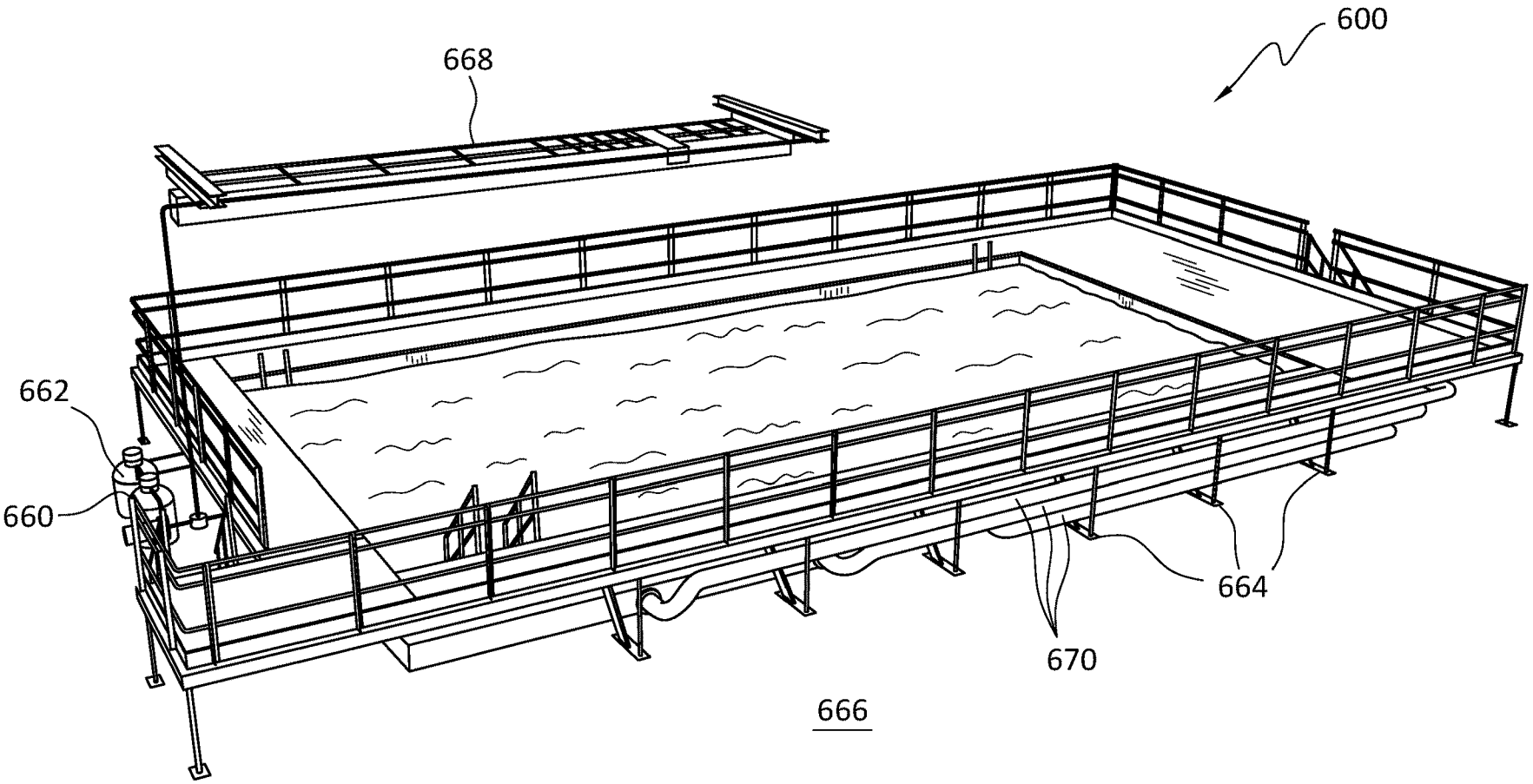
FIG. 6 is a perspective view of a water simulation system in an assembled state according to an embodiment of the disclosure.

In varying embodiments, the water simulation system 100 may further include a deck (e.g., as seen in FIG. 6), a plurality of inlet pumps, a plurality of outlet pumps, one or more flow sensors, one or more light sources, one or more speakers, one or more shower heads or rain simulating devices, one or more air movers, a computing system, a camera, safety connectors such as D-rings or the like, stairs, rails, a lift, a crane, a tower, a waterborne object, and/or a heating, filtration, ventilation, and cooling system. In the example water simulation system 500 of FIG. 5, a second end of the tank is provided with at least one supplemental fluidic outlet. In this embodiment, the supplemental fluidic outlet in the second end is adapted for drawing the liquid of the tank through a filtration system 560 and a heating device 562, before being reintroduced to the tank through supplemental fluid inlets and/or the fluidic inlets 120. In varying embodiments, such a filtration system and/or heating device may be provided at any one or more of the fluidic outlets 120.

Embodiments of the water simulation system may be divided into distinct modules or parts for ease of transport, assembly and disassembly. As a result, the water simulation system may be assembled according to the specific requirements of a user, including by adjusting dimensions, shape, and number of components, and is also portable or moveable through ready disassembly, transport and reassembly.

As illustrated in FIG. 6, the water simulation system 600 may be assembled with a plurality of support arms 664 contacting a floor 666 or surface below the water simulation system for stability and/or strength, such that the water simulation system may be assembled within the interior of nearly any facility, subject to only limited size constraints. As the water simulation system is self-contained, no attachment to structural water sources is required, and the system may simply be connected to a power source for operation.

Advantageously, the water simulation system 600 is adapted for use with a floor 666 that is substantially flat, such that the system 600 can be provided on a conventional floor or surface and does not require specialized flooring or slopes to operate. In this manner, the water simulation system 600 can be assembled and used in a variety of existing general purpose buildings or locations. Notably, the water simulation system 600 may use forced water in a closed system to create the simulation, such that no specialized slope or external water connections are necessary for operation. Instead, the water simulation system 600 can operate on a flat surface or on a generally flat surface with a minor grade or slope. Further, the water simulation system is not a fixture, but is instead a portable piece of equipment that can be positioned in any existing structure or area of suitable size. The advantages of the creation of a water simulation system that is not a fixture are dramatic, as the system allows for ready availability of training in simulated water conditions and the like, without the space, waste and fixture requirements of the prior art.

As previously discussed, the water simulation system 600 may include supplemental systems such as a filtration system 660, a heating system 662, and/or a crane system 668. In particular, a crane system 668 may be provided for attaching a safety harness, for mounting a rain simulating system, for mounting light/sound sources, and/or for use in lifting objects into and out of the tank (e.g., a car for simulating rescue from a flooded vehicle). The crane system 668 may be attached to a frame of the tank (not shown) or to a separate support structure (e.g., ceiling of building or a substantially independent frame system).

In certain aspects, the water simulation system 600 or a portion of the water simulation system 600 may be movable, for example using casters, wheels, tracks or a similar system. For this purpose, a lift system or the like may be employed to elevate the tank and allow removable or retractable elements, such as wheels or casters, to be used to move the tank. Notably, the water simulation system 600 is significantly more configurable than the more permanent installations of the prior art, and may have an empty weight of less than about 120,000 lbs, less than about 110,000 lbs, less than about 95,000 lbs, or even less than about 75,000 lbs, such that movement of the water simulation system 600 is possible without the need for deconstruction or demolition.

A tank of a water simulation system may have a maximum liquid volume of about 143,000 gallons, although the liquid volume is configurable based on the dimensions of the tank.

According to embodiments of a method for performing water simulations using the water simulation system of the current disclosure, a liquid may be simultaneously introduced through the fluidic inlets and withdrawn through the fluidic outlets of the tank. A depth of liquid in the tank may be approximately 4 feet during operation. A swift water flow may be formed at a surface or upper portion of a liquid in the tank while a slower flow is formed below the swift water flow. The water drawn through the fluidic outlets may be drawn by a diffused pressure that is distributed along the length of the tank.

A method for assembling a water simulation system according to embodiments of the disclosure is described with reference to FIGS. 7-8D. The method may comprise forming a floor layout 700 of a tank using a plurality of floor panels 710. In the depicted example, the floor layout 700 comprises twelve floor panels 710 coupled together to provide a sealed surface adapted to retain a liquid. Each of the floor panels 710 may comprise a steel plate having a thickness of ¼ inch, a length of 482 and 13/16 inches, and a width of 80 and ¾ inches, although panels of varying size and materials may be used to form the floor layout 700. For ease of understanding and in some embodiments, such as for ease of manufacturing, the floor panels may be about 30 feet in length by about 5 feet in width. One or more of the floor panels may include chamfered edges for fitting the panels together and/or for fitting to side panels.

The method further comprises forming a first end wall 800*a*, a second end wall 800*b*, a first side wall 800*c* and a second side wall 800*c* according to FIGS. 8A, 8B, 8C and 8D.

The first end wall 800*a* may be formed using a plurality of inlet wall panels 810*a* defining inlet openings 822*a* therein (one of which is shown closed in FIG. 8A) and optionally a plurality of sidewall panels above the inlet wall panels for providing adjustable height, the inlet wall panels 810*a* and the plurality of sidewall panels being coupled together to form a sealed surface at a desired height and adapted to retain a liquid. The second end wall 800*b* may be formed using a plurality of drain panels 810*b* and optionally a plurality of sidewall panels being coupled together to form a sealed surface at the same desired height and adapted to retain a liquid. The first sidewall 800*c* and the second side wall 800*c* may be formed using a plurality of drain panels 810*c* and optionally a plurality of sidewall panels 811*c* being coupled together to form a sealed surface at the same desired height and adapted to retain a liquid. In some embodiments, the panels of the second end wall 800*b* may be of substantially identical dimension to those of the side walls 800*c*, the second end wall including less of said panels in the illustrated embodiment in order to accommodate a rectangular shape for the tank 800*d* of FIG. 8D.

In one example, the inlet wall panels 810*a*, the drain panels 810*b*, 810*c*, and the sidewall panels may comprise steel plates having a thickness of about 3/16 inch and a length of 118 and 13/16 inches, or about 10 feet, and a height of about 6 feet, although panels of varying size and materials may be used to form the tank 800*d*. The drain panels 810*b*, 810*c* may include an intake plate 450 of an intake diffusion system 440 as discussed with respect to FIGS. 4A and 4B, while the inlet wall panels 810*a* may include inlet openings for accommodating the inlets of the water simulation system.

The intake plate 450 of FIG. 4B may be provided as a drain panel, for example having dimensions of 6 feet by 10 feet. As shown in the exploded view, the intake holes 452 may have centers spaced apart by about 1 inch in the length direction, with rows of intake holes separated by about 1 inch in the height direction and staggered by about 0.5 inch.

According to the method, the floor layout 700, the first end wall 800*a*, the second end wall 800*b*, the first side wall 800*c* and the second side wall 800*c* may be coupled together to form the tank 800*d*. The method may further comprise attaching a plurality of drain boxes to the drain panels 810*b*, 810*c*, and coupling at least some of the drain boxes to the inlet wall panels 810*a* with fluidic outlets, fluidic outlets and at least one pump according to the varying embodiments disclosed herein.

Figure 8A:
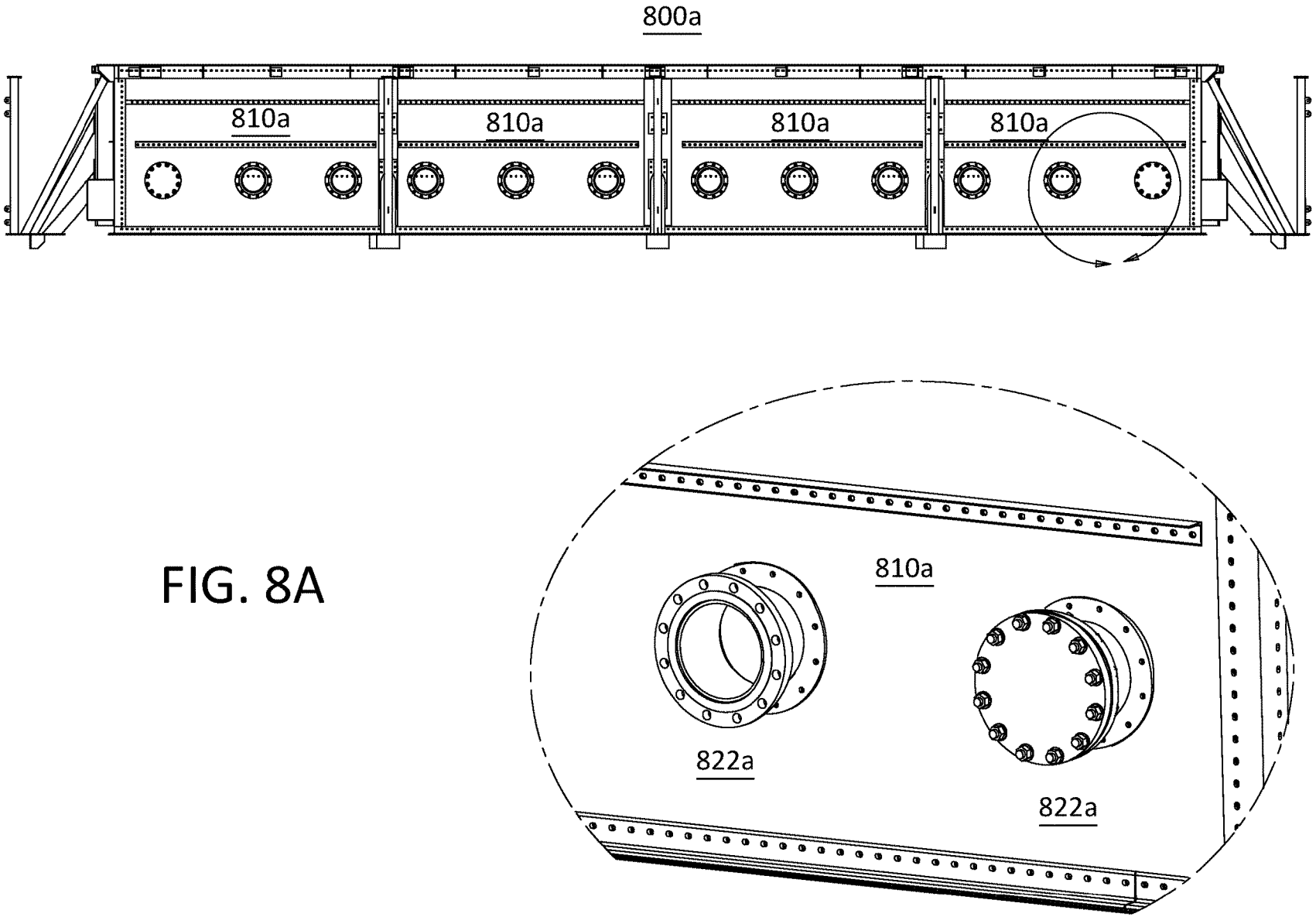
FIG. 8A is a diagram of an end wall of a water simulation system according to an embodiment of the disclosure.
Figure 8B:
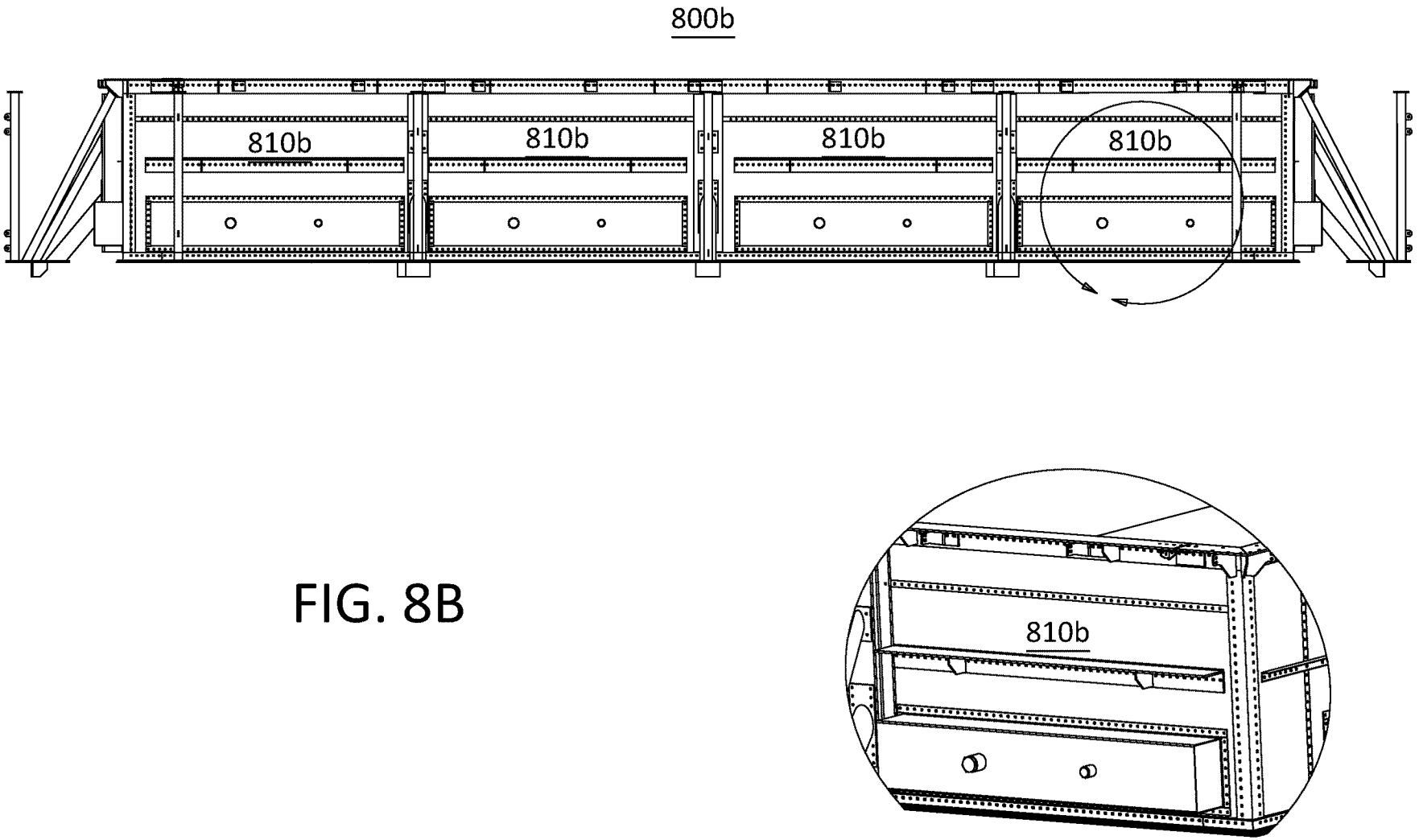
FIG. 8B is a diagram of another end wall of a water simulation system according to an embodiment of the disclosure.
Figure 8C:
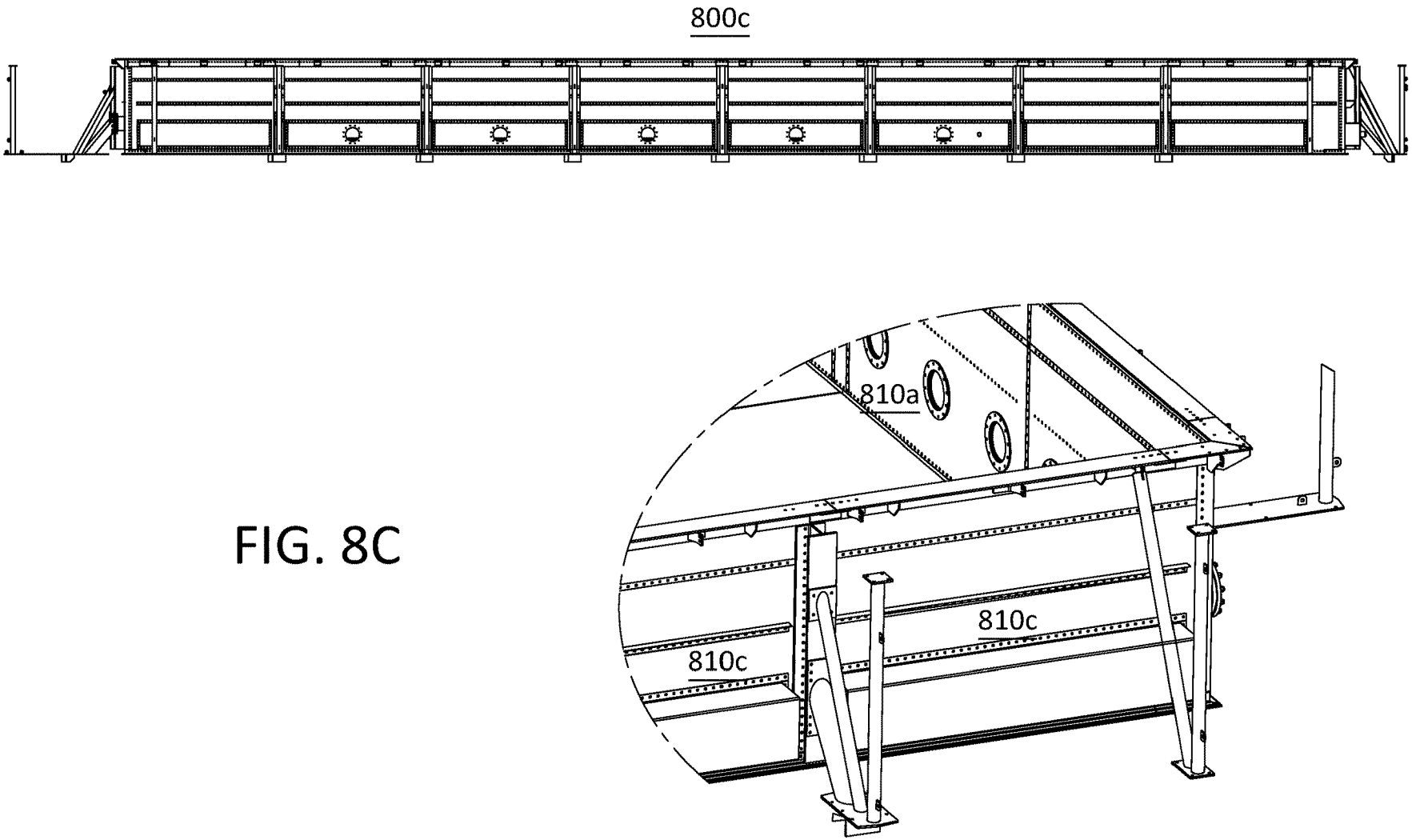
FIG. 8C is a diagram of a side wall of a water simulation system according to an embodiment of the disclosure.
Figure 8D:
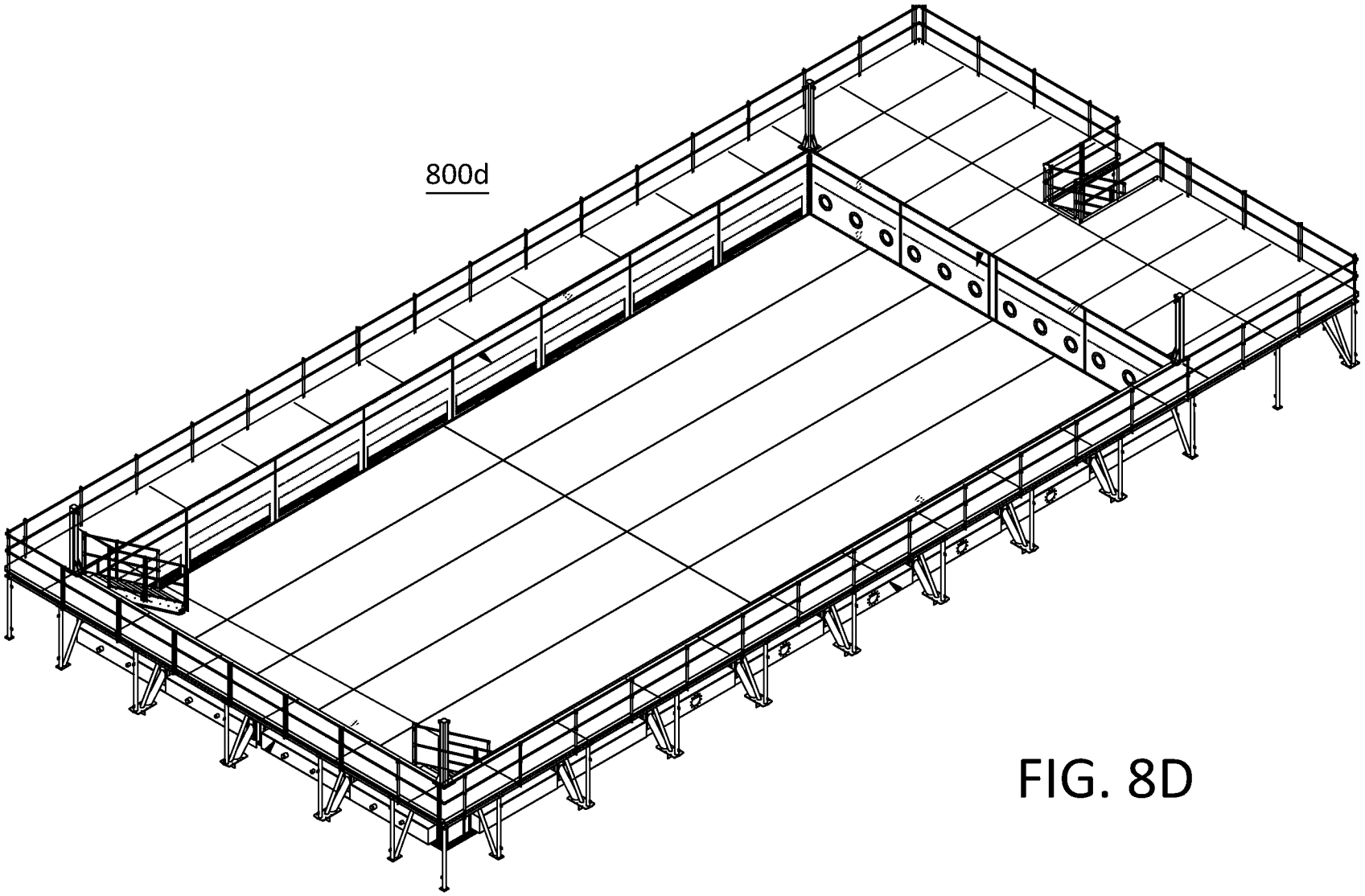
FIG. 8D is a perspective view of a water simulation system according to an embodiment of the disclosure.

According to the depicted example of FIG. 8D, the tank 800*d* may have a length dimension in a range of about 40 to 120 feet, more particularly about 60 to 100 feet, or about 80 feet. A width dimension of the tank 800*d* may be in a range of about 20 to 60 feet, more particularly about 30 to 50 feet, or about 40 feet. A height or depth dimension of the tank 800*d* may be in a range of about 4 to 8 feet, or about 6 feet. An average liquid depth in the tank 800*d* may be about 4 feet during operation. In some embodiments having a depth of liquid greater than 6 feet, additional external support may be required for the end and side walls. This may be accomplished by enclosing the rectangular tank in a another cylindrical tank, such that liquid may be added to the cylindrical tank for supporting the end and side walls of the rectangular tank.

Some implemented examples include tanks having width×length dimensions of 10×20 feet, 30×60 feet and 40×80 feet, the size of the tank being selected based on the desired specifications of the intended simulations. Surprisingly, it has been discovered that some unique and advantageous water current simulations of the current disclosure are only possible in tanks with specific dimensions. Preferably, tanks according to the current disclosure are about twice as long as they are wide. This specific ratio preserves a particular relationship between the inflows and outflows of the system, such that the swift water flow and the current water flow are appropriately separated and no rebounding effects disrupt the simulation.

Figure 7:
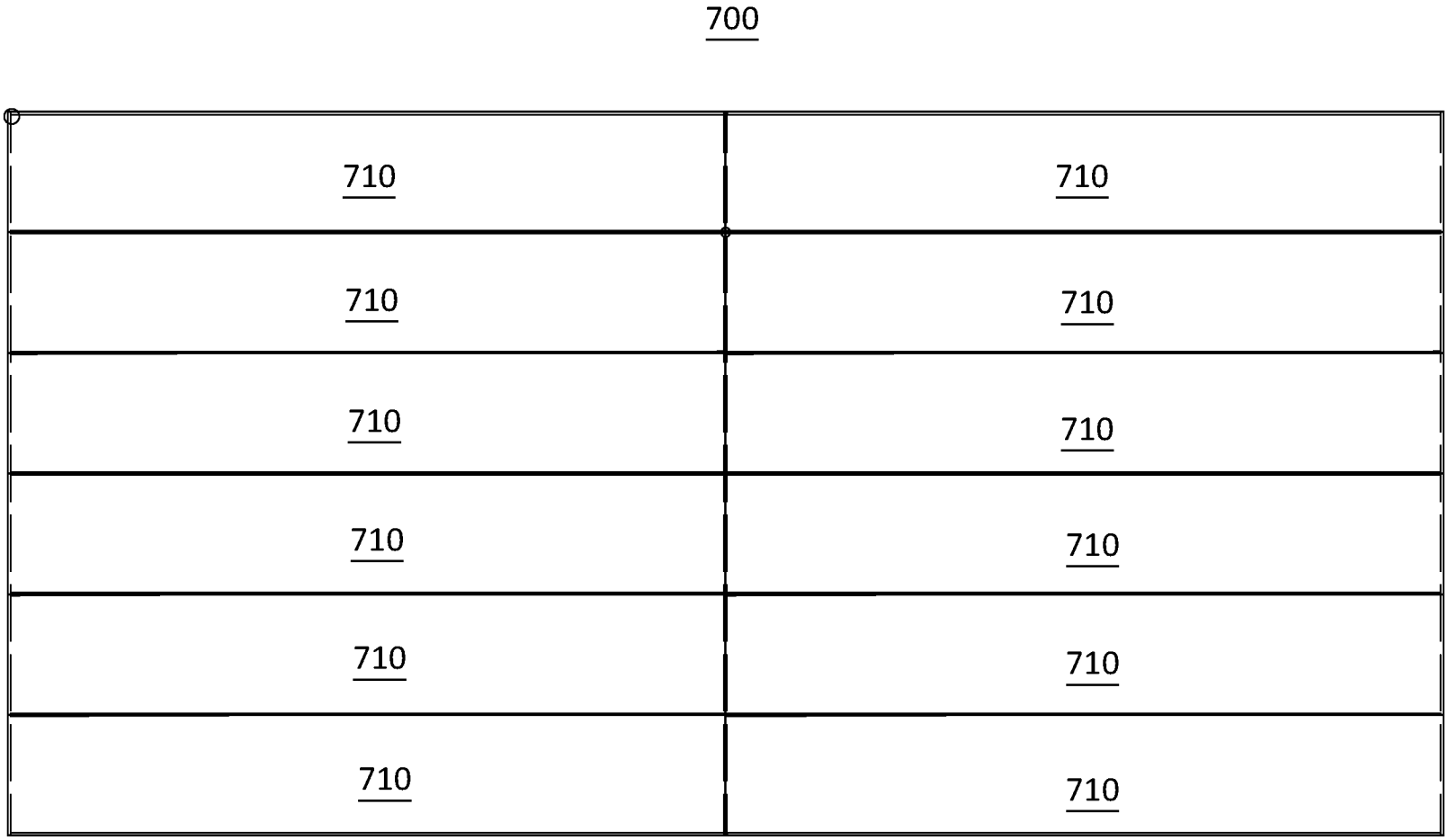
FIG. 7 is a plan diagram of a floor layout of a water simulation system according to an embodiment of the disclosure.

A kit for forming a water simulation system according to embodiments of the current disclosure may be provided comprising a plurality of floor panels, a plurality of inlet wall panels, a plurality of drain panels, and a plurality of sidewall panels, for example according to the illustrations of FIGS. 7-8D. In some aspect, each individual side panel and end panel may have the same height and length, such as 6 feet by 10 feet. This configuration advantageously enables the assembly of tanks with different size configurations through the use of more or less panels. The kit may include a plurality of connector and support elements such as bolts, bars and the like, which may be implemented with sealing elements such as gaskets, washers and/or nuts for sealing the tank, for example made of rubber or a similar material. The kit may further comprise fluidic inlets, fluidic outlets and at least one pump for driving a water simulation according to the embodiments discussed.

It is an advantage of the disclosed embodiments that such a kit may be used to form a water simulation system of varying dimensions by the use of a greater or lesser number of panels. Further, it has been surprisingly discovered that the kit can be readily transported in the form of disassembled panels, assembled together to form a water simulation system in a desired location, and is further capable of disassembly to form the kit of separated parts for storage and/or transport. Notably, such disassembly, transport and reassembly can be accomplished in a relatively short timeframe, an advantage that is inconceivable in systems of the prior art. In some examples, about or less than 250 man hours may be needed for disassembly, with about or less than 250 man hours needed for assembly.

It is to be understood from the current disclosure that the features of the illustrated embodiments may be combined to meet the requirements or characteristics of a particular water or hazard simulation, such as adjusting for varying flow direction and strength. Accordingly, embodiments according to the current disclosure may incorporate variations in size, shape, and/or materials, as conventionally understood in view of the current disclosure or otherwise in whole or in part from one embodiment to another.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

The invention claimed is:

1. A swift water rescue simulation system comprising:

a tank defining an opening at a top end, wherein the tank is configured to be disassembled and reassembled with a plurality of panels, a crane system positioned above the opening of the tank to lift objects into and out of the tank;

a plurality of fluidic inlets provided in a first end of the tank;

a plurality of fluidic outlets provided in a first side and/or a second side of the tank; and one or more pumps configured to introduce liquid into the tank through the plurality of fluidic inlets and to draw the liquid from the tank through the plurality of fluidic outlets;

wherein the plurality of fluidic inlets include a plurality of current water inlets configured to provide a current flow at a first velocity and in a first direction, and a plurality of swift water inlets that each include a snorkel above a waterline of the tank, the swift water inlets configured to provide a swift water flow at a second velocity and in the first direction that create white water conditions, the second velocity being higher than the first velocity, wherein the current flow and the swift water flow are separated based at least in part on the length of tank being approximately twice as long as the width.

2. The swift water rescue simulation system of claim 1, wherein the second velocity is 2-3 knots higher than the first velocity.

3. The swift water rescue simulation system of claim 1, wherein the plurality of swift water inlets introduce the liquid into the tank at a height greater than a height of the plurality of current water inlets.

4. The swift water rescue simulation system of claim 3, wherein each of the snorkels having:

a reducer for increasing the velocity of the liquid through the plurality of swift water inlets; and/or an extended arm for increasing the height at which the plurality of swift water inlets introduce the liquid into the tank.

5. The swift water rescue simulation system of claim 1, wherein a number of the plurality of swift water inlets is equal to a number of the plurality of current water inlets.

6. The swift water rescue simulation system of claim 1, wherein the plurality of fluidic inlets is arranged across a horizontal dimension of the first end of the tank, such that the plurality of swift water inlets and the plurality of current water inlets are arranged alternatingly across said horizontal dimension.

7. The swift water rescue simulation system of claim 1, wherein each of the plurality of fluidic inlets is coupled to one of the plurality of fluidic outlets via a fluidic path.

8. The swift water rescue simulation system of claim 7, wherein a number of the plurality of fluidic inlets is equal to a number of the plurality of fluidic outlets.

9. The swift water rescue simulation system of claim 1, wherein the plurality of fluidic outlets comprise at least one intake box defining a recess in the first and/or second side of the tank.

10. The swift water rescue simulation system of claim 9, wherein the at least one intake box comprises an intake plate corresponding with the surface of the first and/or the second side of the tank, the intake plate defining a plurality of intake holes therein.

11. The swift water rescue simulation system of claim 1, wherein the plurality of fluidic outlets draw the liquid from the tank in a second direction different than the first direction.

12. The swift water rescue simulation system of claim 1, wherein the plurality of fluidic outlets draw the liquid from the tank at a height lower than a height of the plurality of current water inlets.

13. The swift water rescue simulation system of claim 1, wherein the plurality of panels comprise a plurality of bolted-metal panels.

14. The swift water rescue simulation system of claim 4, wherein the arm of each of the snorkels extends from the first end of the tank and is rotatable for adjusting a direction and/or height at which the liquid is introduced into the tank from the plurality of swift water inlets.

15. The swift water rescue simulation system of claim 10, wherein the plurality of fluidic outlets comprise a plurality of intake boxes including the at least one intake box.

16. The swift water rescue simulation system of claim 15, wherein the plurality of intake boxes cover a length that is at least 75% of a length of the first side of the tank; and/or wherein the plurality of intake boxes cover a length that is at least 75% of a length of the second side of the tank.

17. The swift water rescue simulation system of claim 15, wherein a number of the plurality of intake boxes is equal to a number of the plurality of fluidic outlets.

* * * * *